United States Patent [19]

Kunieda et al.

[11] 4,155,685

[45] May 22, 1979

[54] GAS SEAL ARRANGEMENT BETWEEN ROTOR AND HOUSING

[76] Inventors: Eiichi Kunieda; Yoshiko Kunieda, both of 5-22, Kaneda-cho, Kita-ku, Nagoya-shi, Aichi-ken, Japan

[21] Appl. No.: 815,605

[22] Filed: Jul. 14, 1977

[30] Foreign Application Priority Data

Jul. 14, 1976 [JP] Japan ..... 51-83726
Jul. 19, 1976 [JP] Japan ..... 51-85806

[51] Int. Cl.[2] ..... F01C 19/04; F01C 19/08; F04C 27/00

[52] U.S. Cl. ..... 418/112; 418/121; 418/122; 418/142; 418/146; 418/148

[58] Field of Search ..... 418/120–123, 418/142, 146–148, 112

[56] References Cited

U.S. PATENT DOCUMENTS

| | | | |
|---|---|---|---|
| 526,801 | 10/1894 | Blackwell | 418/148 |
| 754,031 | 3/1904 | Williams | 418/121 |
| 775,212 | 11/1904 | Early | 418/142 |
| 1,350,775 | 8/1920 | Brauer | 418/112 |
| 1,980,726 | 11/1934 | Higbee | 418/146 |
| 2,829,603 | 4/1958 | Clark | 418/112 |
| 3,829,252 | 8/1974 | Nakano | 418/146 |
| 3,930,767 | 1/1976 | Hart | 418/142 |
| 3,951,112 | 4/1976 | Hunter | 418/146 |
| 3,963,388 | 6/1976 | Goloff | 418/121 |
| 3,985,110 | 10/1976 | Doundoulakis | 418/121 |

FOREIGN PATENT DOCUMENTS

| | | | |
|---|---|---|---|
| 282263 | 12/1927 | United Kingdom | 418/148 |

*Primary Examiner*—John J. Vrablik
*Attorney, Agent, or Firm*—Connolly and Hutz

[57] ABSTRACT

Gas seal characterized in that a groove is formed on a rotor or on a sealing piece slidably embedded in the rotor. An apex seal, outwardly urged in the radial direction, is slidably inserted in the groove and both ends of the apex seal are so supported by a corner seal block that the apex seal does not slip out of the rotor. At the same time the seal block assures air-tightness of the rotor ends, thereby effectively sealing the rotor against the housing.

1 Claim, 8 Drawing Figures

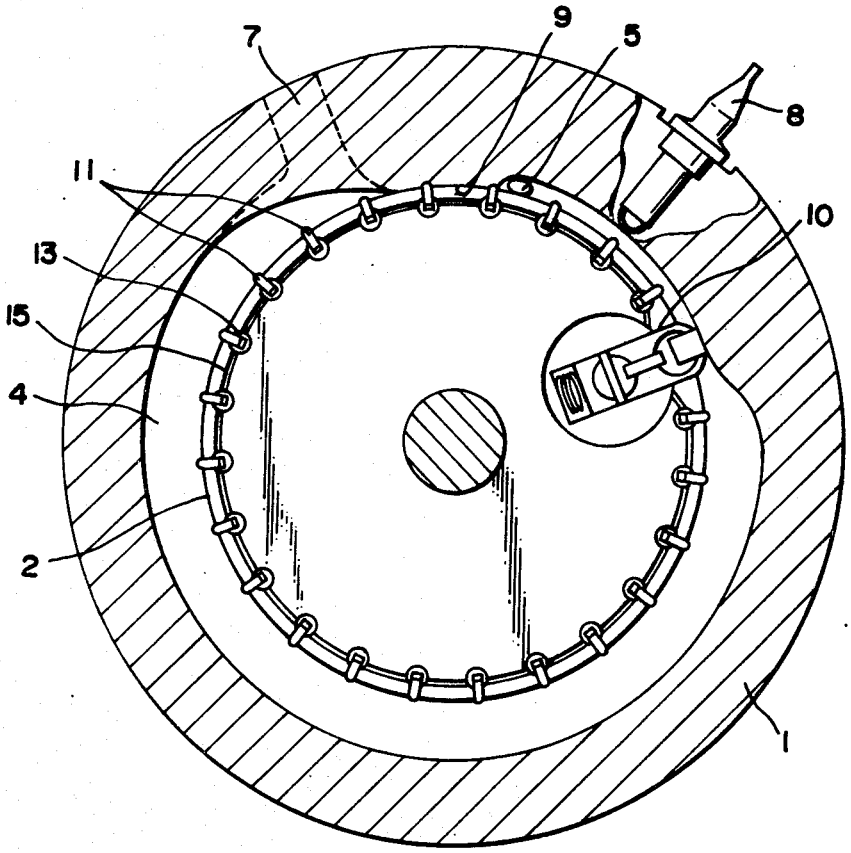

GAS SEAL ARRANGEMENT BETWEEN ROTOR AND HOUSING

BACKGROUND OF THE INVENTION

The present invention relates to a gas seal between a rotating body and a plane to which the body must be kept airtight in a rotary engine or in a compressor.

It is vitally important for the sake of maintaining machine efficiency to prevent gas leakage between a rotating body and a plane to which the body must be kept airtight in a rotary engine or in a compressor.

The rotating body and a plane to which the body has to be kept airtight differ depending on the type of the rotary engine. In an engine of the type having a circular rotor rotatably housed within the housing and wherein a pair of the inside surface of the housing protrudes toward the rotor to slide against the rotor, the rotating body is the rotor and the plane to be kept airtight is the rotor-sliding part of the housing.

Moreover, in an engine of the type having a rotor rotatably housed within the housing, a recess on the inside surface of the housing, a circular rotary seal rotatably provided in the recess, and a projection out from the recess in the rotary seal which slides against the rotor, the rotating body is the rotary seal and the plane to be kept airtight is the rotary seal-contacting part of the recess in the housing or the rotary seal-contacting part of the rotor.

The conventional method of keeping such parts airtight includes providing an apex seal on the housing side instead of on the rotor side and pressing the apex seal against the rotor with gas pressure to thereby maintain airtightness between the rotor and the housing.

For structural reasons of the rotary engine or the compressor, however, it sometimes happens that the sealing means must be provided on the rotor side, and in that case the specific structure of the sealing means is important together with the location of that means on the rotor surface and the airtightness between the two longitudinal ends of that means and the housing. Especially when the sealing means is elongated in the radial direction of the rotor, the airtightness between the longitudinal ends of that means and the housing presents a serious problem.

SUMMARY OF THE INVENTION

The main object of the present invention is to provide a specific structure of the apex seal provided on the rotor side of a rotary engine or compressor.

Another object of the present invention is to provide a gas seal in which the problem of airtightness between the longitudinal ends of a sealing piece elongated in the radial direction of the rotor and the housing has been successfully solved.

Still another object of the present invention is to provide a gas seal for a rotary engine with sealing means that assures perfect airtightness between the rotor and the plane to be sealed against the rotor.

A gas seal comprises a groove formed in a rotor member itself or a sealing piece slidably embedded in the rotor. An apex seal is slidably positioned within the groove and the seal is urged outwardly in the radial direction by suitable spring means. The ends of the apex seal are supported by corner seal blocks that prevent the seal from slipping out of the rotor. The seal blocks also provide an airtight seal between the rotor ends and the housing.

BRIEF DESCRIPTION OF THE DRAWINGS

Novel features and advantages of the present invention will become apparent to those skilled in the art from a reading of the following detailed description in conjunction with the accompanying drawings wherein.

DETAILED DESCRIPTION OF THE INVENTION

Figure 1:
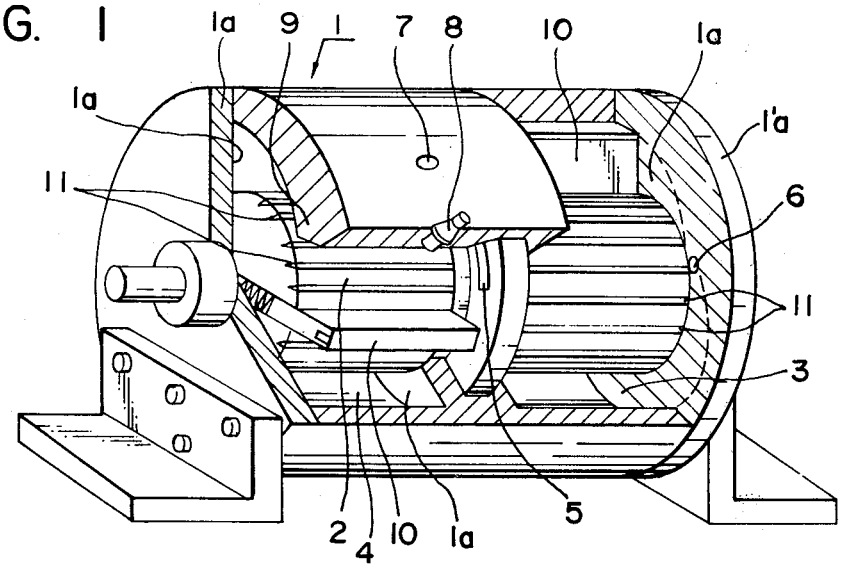
FIG. 1 is a partially cutaway oblique view of a rotary engine equipped with a gas seal, according to the present invention.
Figure 2:
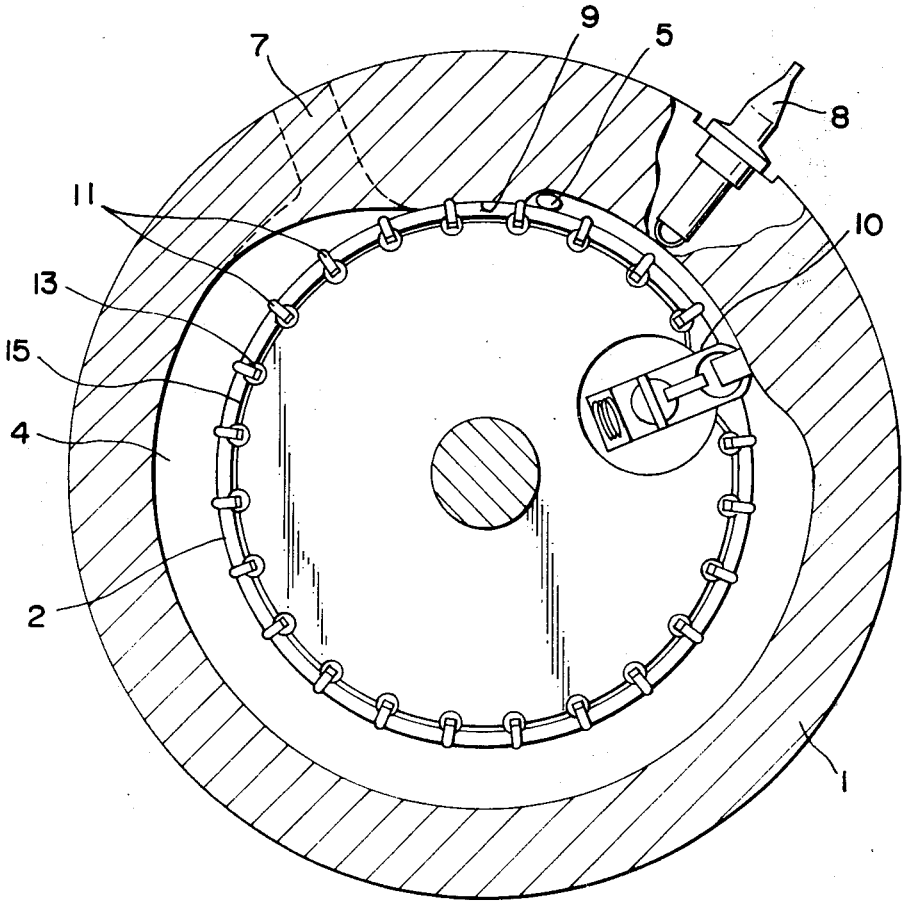
FIG. 2 is a section view of the engine shown in FIG. 1 at the rotor end position.

FIGS. 1 and 2 illustrate a gas seal according to the present invention as applied to a rotary engine of the type having a circular rotor within a housing and wherein a portion of the housing fits against the rotor making sliding contact therewith. The engine has a housing 1 and a rotor 2 is rotatably fitted within the housing 1. The annular space between the housing 1 and the rotor 2 is axially split into two parts, one part constituting the engine chamber 3 for suction and compression and the other part constituting the engine chamber 4 for explosion and exhaustion. Between the two chambers 3, 4 there is a communication path 5 free to open and close. In the chamber 3 there is a suction hole 6, and in the chamber 4 there is an exhaustion hole 7 and a spark plug 8.

The chambers 3, 4 are radially split into multiple spaces by the division wall 9 smoothly protruding on the rotor side in the housing 1 and the sealing piece 10 provided on the rotor 2 and rotatably therewith. Relative movement of the sealing piece 10 to the wall 9 causes suction, compression, explosion, or exhaustion.

For the purpose of maintaining airtightness between the rotor and a place to be sealed against the rotor, i.e., the division wall 9 internally formed in the housing 1, a plurality of apex seals 11 are arranged parallel to each other on the periphery of the rotor 2. The apex seals are spaced from one another such that during the rotation of the rotor 2 at least one apex seal 11 comes into contact with the wall 9.

Figure 3:
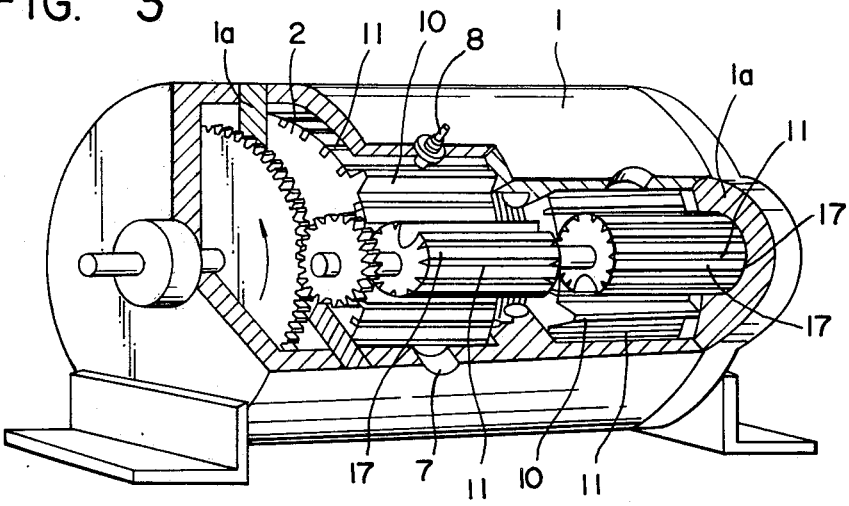
FIG. 3 is a partially cutaway oblique view of a different type of rotary engine from the one illustrated in FIGS. 1 and 2, also equipped with a gas seal, according to the present invention.
Figure 4:
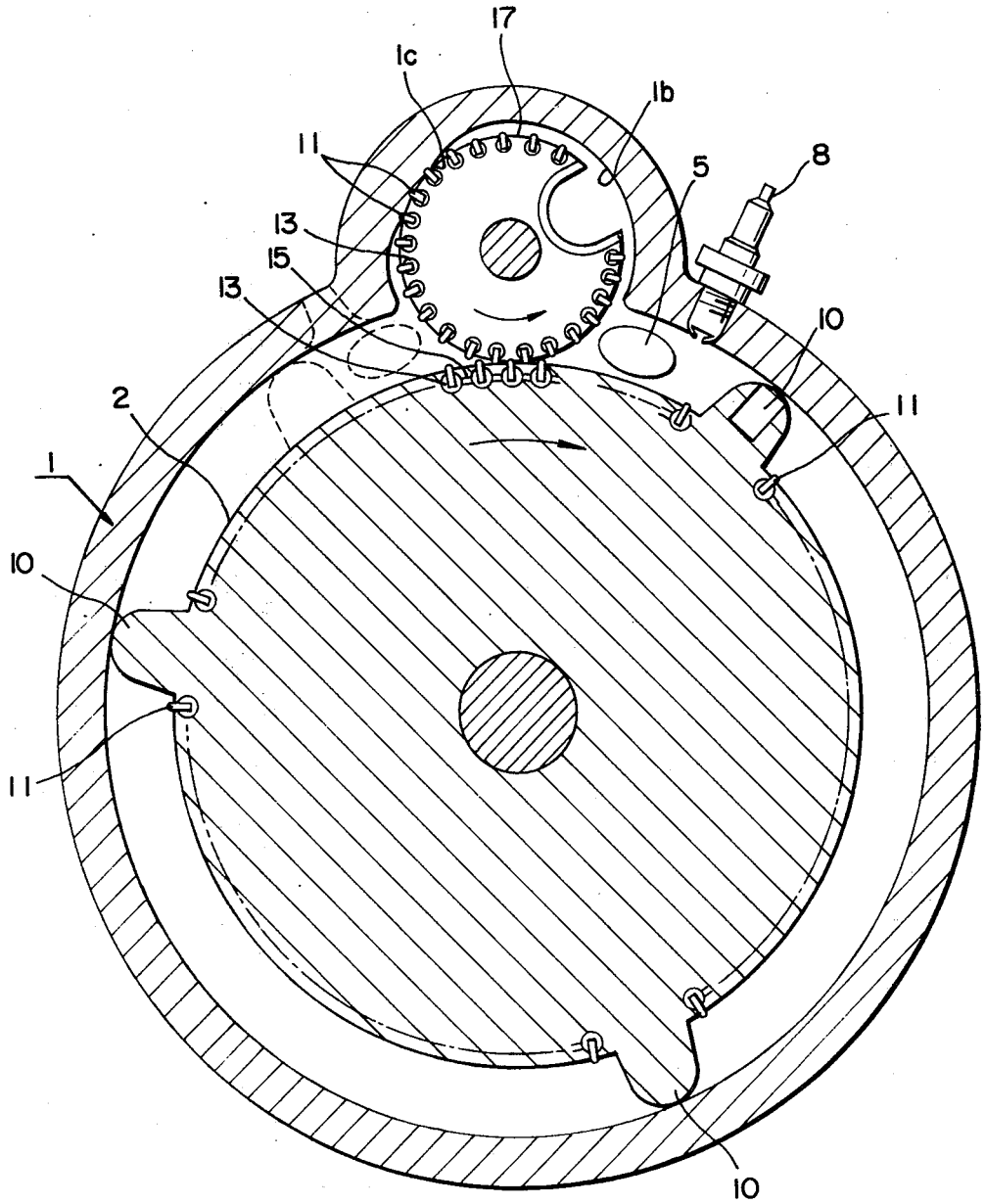
FIG. 4 is a section view of the engine shown in FIG. 3 at the rotary seal end position.

FIGS. 3 and 4 illustrate a gas seal according to the present invention as applied to a different type of rotary engine from the one illustrated in FIGS. 1 and 2. In the engine of FIGS. 3, 4 like parts of the engine of FIGS. 1 and 2 are denoted by like symbols to omit detailed description. A major structural difference lies in that the division wall 9 in the chambers 3, 4 of the engine of FIGS. 1 and 2 is replaced with the rotary seal 17. To be more specific, a recess 1*b* is provided on the housing 1 and a rotary seal 17 is rotatably fitted in the recess 1*b*. At the same time a projection 1*c*, smoothly protruding toward the rotary seal 17, is formed in the recess 1*b* and the projection 1*c* is in sliding contact with the rotary seal 17.

A part of the rotary seal 17 protrudes out from the recess 1*b* toward the rotor 2, and with the projection in contact with the rotor 2, the longitudinal airtightness of the rotary seal 17 in the chambers 3, 4 is achieved. In this case therefore, the rotating body is the rotary seal 17 and the plane to be sealed against the rotary seal 17 is the rotary seal-contacting plane of the projection 1*c* and the rotary seal-containing plane of the rotor 2. To maintain the airtightness at all times during the rotation of the rotary seal 17, the same kind of apex seal 11 as arranged on the periphery of the rotor 2 illustrated in FIGS. 1 and 2 is provided on the periphery of the rotary seal 17.

Figure 5:
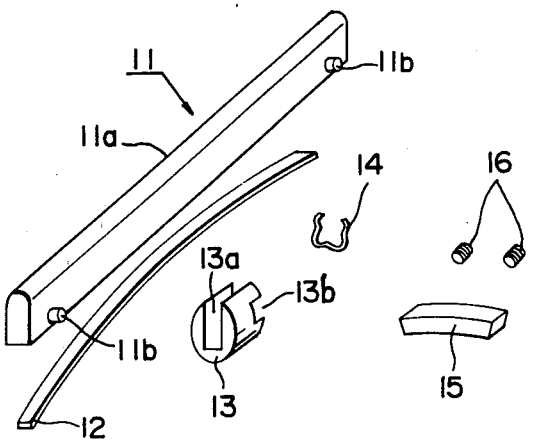
FIG. 5 is an exploded view of a gas seal, according to the present invention.
Figure 6:
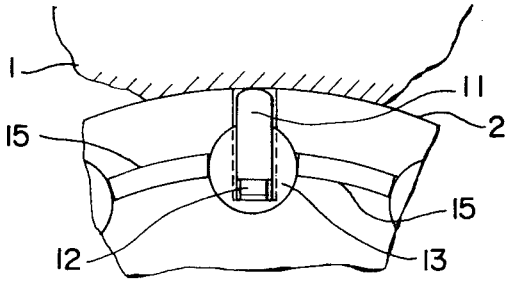
FIG. 6 is an enlarged view of the various components shown in FIG. 5 in reassembled condition.

The structure of the apex seal 11 is best shown in FIGS. 5 and 6. The apex seal 11 consists of a stopper 11*b* extending outwardly from each end of the rib seal 11*a*. The rib seal is slidably fitted into the recess provided in the axial direction on the periphery of the rotor 2. Between the apex seal 11 and the rotor 2 is inserted an apex seal-hold spring 12 which urges the apex seal outwardly in the radial direction of the rotor. At the axial ends of the rotor 2, circular recesses are formed at the positions corresponding to both ends of the apex seal 11 and a circular corner seal block 13 slidably fits into the recess. The corner seal block 13 has a notch 13*a* into which the rib seal 11*a* of the apex seal 11 slidably fits, and a notch 13*b* that engages the stopper 11*b*. Thus with the apex seal 11 supported through the stoppers 11*b* by the corner seal block 13, and the corner seal block 13 fitted in the circular recess at the end of the rotor 2, the apex seal 11 is not dislodged even when the rotor 2 rotates. A seal block-hold spring 14 is between the corner seal block 13 and the rotor 2. The hold spring 4 urges the corner seal block 13 in the lateral 1*a* direction of the housing 1. Between the corner seal blocks 13 a rib-like side seal 15 is inserted in the groove provided at the end of the rotor 2 and it is pressed in the lateral 1*a* direction of the housing 1 by the side seal-hold spring 16 inserted between the side seal 15 and the rotor 2.

In a rotary engine thus constituted, when pressure is exerted from one side to the other side of the division wall 9 in the chamber 3 or 4, the apex seal 11 is pressed by this pressure against the side wall of the groove in the rotor 2 and the division wall 9, thereby sealing the wall 9 against the rotor 2. Meanwhile the corner seal block 13 and the side seal 15 are pressed against the housing side 1*a*, thereby sealing the end of the rotor 2 against the housing. The above-mentioned sealing is mainly effected by gas pressure, but the springs 12, 14, 16 which urge the sealing members are also supplementally contributing to the sealing. Since the springs 12, 14, 16 are arranged to urge the sealing members 11, 13, 15 in the direction of the housing 1, the gas pressure working on these members invariably presses these members in the direction of the housing 1, thereby effecting the sealing between the rotor 2 and the housing 1.

Figure 7:
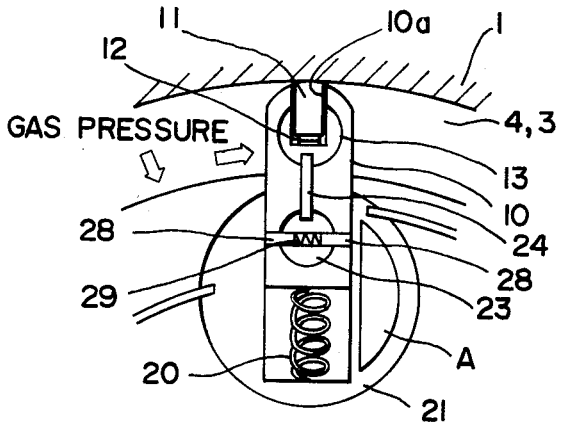
FIG. 7 is an enlarged section view of the sealing piece.
Figure 8:
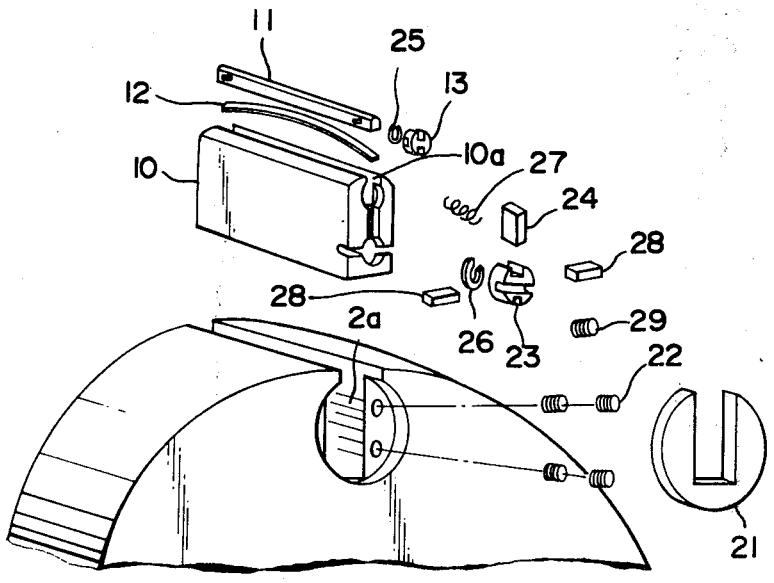
FIG. 8 is an exploded view of the various components shown in FIG. 7.

The sealing mechanism of a sealing means elongated in the radial direction of the rotor, i.e., the sealing piece illustrated in FIGS. 1 and 2 functions as follows. As indicated in FIGS. 7 and 8, the sealing piece 10 slidably fits into the groove 2*a* provided on the periphery of the rotor 2 to be openable outward in the radial direction. Sealing piece 10 is pressed against the inside 1*a* of the housing 1 by the spring 20 which urges it outwardly in the radial direction. Thus when the rotor 2 rotates, the sealing piece 10 as it passes the division wall 9 has its tip buried in the rotor 2 to the extent that it becomes flush with the periphery of the rotor 2, and after passing the division wall 9 it extends outwardly from the periphery of the rotor 2 to the extent that it contacts the inside 1*a* of the housing 1. Namely, the sealing piece 10 repeats an in and out movement relative to the rotor 2 with the rotation of the rotor 2.

The sealing piece 10 is provided with an outwardly open groove 10*a* in the radial direction of the rotor 2 and in this groove 10*a* is slidably inserted a rib-like apex seal 11. The apex seal 11 is urged outwardly in the radial direction of the rotor by an apex seal spring 12 interposed between the apex seal 11 and the bottom of the groove 10*a*. The tip of the apex seal 11 is slidingly pressed against the inside surface of the housing 1.

Since the sealing piece 10 is elongated in the radial direction of the rotor, a gas leak-preventing means should be provided between the axial end of the sealing piece 10 and the lateral surface of the housing 1. The sealing piece 10 is equipped with such a means, and referring to FIGS. 7 and 8, such means is described in detail as follows.

For the purpose of gas sealing between the longitudinal ends of the rotor 2 and the lateral surface of the housing 1, a circular recess is formed at both longitudinal ends of the rotor 2 and a double corner seal block 21 is inserted in the recess. The double corner seal block 21 is urged in the direction of the housing 1 and pressed by the compressive spring 22 against the housing 1. The sliding surface of the double corner seal block 21 against the housing 1 may have its mid-portion formed concave as indicated by A in FIG. 7 to decrease frictional resistance.

On the other hand at the longitudinal ends of the sealing piece 10 a corner seal block 13 is provided outside the radial direction of the rotor, and a plug seal 23 is provided inside the radial direction of the rotor. A rib seal 24 is provided between the corner seal block 13 and the plug seal 23. The corner seal block 13, plug seal 23 and the rib seal 24 are respectively urged in the axial direction of the rotor and pressed against the lateral surface of the housing by the springs 25, 26 and 27. Meanwhile the plug seal 23 has a groove in the rotating direction of the rotor and two rib seals 28 are slidably inserted into the groove. The rib seals 28 are urged in mutually opposite directions and pressed against the side wall of the groove 10*a* by rib seal push spring 29 provided between two rib seals 28 in the rotating direction of the sealing piece.

With a gas seal of a rotary engine thus constituted, when a gas pressure works in the direction of the arrow of FIG. 7, the gas pressure forces the apex seal 11 against the inside of the housing 1 and the side wall of the groove 10*a* in the sealing piece 10. This action slidably seals the sealing piece against the housing 1. Meanwhile the sealing between the sealing piece 10 and the rotor 2 is effected as a result of the sealing piece 10 being pressed by the gas pressure against the side wall of the groove 2*a* in the rotor 2.

On the other hand, the sealing between the rotor-axial ends of the sealing piece 10 and the inside surface of the housing 1 is effected as a result of the corner seal block 13, the plug seal 23, the rib seal 24, and the rotating direction rib seal 28 being pressed by the gas pressure against one side of the groove provided on the sealing piece 10 to accommodate these seals and against the lateral surface of the housing 1. The above-mentioned sealings are mainly accomplished by the gas pressure and supplementally assisted by the springs 20, 12, 25, 26, 27 and 29 which urge the sealing members. Since these springs are arranged such that they urge the sealing members in the direction of the housing 1, gas pressure working on these members invariably presses these members against the housing 1.

By virtue of the above-mentioned sealing effect, the chambers 3, 4 are perfecly sealed both ways in the rotational direction of the sealing piece 10, thereby preventing gas leakage between the suction zone and the compression zone in the chamber 3 and between the explosion zone and the exhaustion zone in the chamber 4. Engine efficiency is thereby maintained.

The above description mainly concerns the application of the present invention to the sealing piece in a rotary engine of the type illustrated in FIG. 1, but it goes without saying that the present invention is also applicable to the apex seal in a common type Wankel type rotary engine or in a compressor, wherein a side seal is required because of elongation in the radial direction of the rotor.

Such being the constitution and effect of the present invention, the sealing piece interposed between the rotor and the housing fully assures the sealing in the rotational direction of the sealing piece. Even if the sealing piece is elongated in the radial direction of the rotor, lateral gas leakage in the axial direction of the sealing piece is prevented. Moreover, being operated mainly by a difference in the gas pressure, the gas seal according to the present invention is highly reliable and effective.

What is claimed is:

1. A gas seal arrangement between a rotor having a circular cross section with a concentric axis of rotation and a stationary housing having a configured interior surface and opposed end walls comprising at least one first longitudinal groove in the rotor, first sealing means extending the length of the rotor between the opposed end walls of the stationary housing slidably fitted in the groove for movement in a radial direction relative to the rotor with the outer portion of such means in constant engagement with the configured interior surface of the stationary housing, a plurality of spaced apart secondary longitudinal grooves over the surface of the rotor, secondary sealing means extending the length of the rotor between the opposed end walls of the housing slidably fitted in each of the secondary grooves for movement in a radial direction relative to the rotor with the outer portion of one or more but not all of such means in engagement with the configured interior surface of the stationary housing at any relative position of the rotor and housing, a plurality of sealing members at the ends of the rotor extending between the first and secondary sealing means to form a continuous seal between the rotor ends and the end walls of the stationary housing, each secondary sealing means comprising an apex seal urged in an outward radial direction relative to the rotor, and spaced apart corner block means fitted into the ends of the rotor for supporting the apex seal while preventing it from slipping out of its associated secondary longitudinal groove, the first sealing means comprising a sealing piece fitted into the first longitudinal groove of the rotor, a longitudinal groove in the outer end portion of the sealing piece, an apex seal slidably fitted in the groove of the sealing piece urged in an outward radial direction relative to the sealing piece, spaced apart corner block means fitted into the ends of the sealing piece for supporting the apex seal while preventing it from slipping out of the groove in the sealing piece, a recess formed at both ends of the sealing piece radially inside of the corner block means, a plug seal in the recess urged in the direction of the housing, a rib seal at both ends of the sealing piece for sealing between the corner block means and the plug seal, and a rotational direction rib seal for sealing between the plug seal and the rotor.

* * * * *